US007445583B2

(12) United States Patent
Chen

(10) Patent No.: US 7,445,583 B2
(45) Date of Patent: Nov. 4, 2008

(54) PIVOTAL DISPLAY FOR STATIONARY EXERCISE BICYCLE

(76) Inventor: James Chen, No. 280, Nangang 3rd Rd., Nantou City, Nantou County (TW)

( * ) Notice: Subject to any disclaimer, the term of this patent is extended or adjusted under 35 U.S.C. 154(b) by 33 days.

(21) Appl. No.: 11/582,733

(22) Filed: Oct. 17, 2006

(65) Prior Publication Data

US 2008/0093517 A1 Apr. 24, 2008

(30) Foreign Application Priority Data

Sep. 26, 2006 (TW) ..... 95217128 U

(51) Int. Cl.
*A63B 22/06* (2006.01)

(52) U.S. Cl. ..... 482/57; 248/123.11; 248/279.1; 248/280.11; 248/285.1; 248/291.1; D8/363; D8/380

(58) Field of Classification Search ..... 482/57
See application file for complete search history.

(56) References Cited

U.S. PATENT DOCUMENTS 5,480,365 A * 1/1996 Lundin et al. ..... 482/53
5,765,794 A * 6/1998 Chen ..... 248/292.12
5,941,493 A * 8/1999 Cheng ..... 248/371
5,964,443 A * 10/1999 Leveille ..... 248/478
6,015,368 A * 1/2000 Clem et al. ..... 482/54
6,065,732 A * 5/2000 Cho ..... 248/371
6,085,972 A * 7/2000 Wright ..... 235/375
6,229,584 B1 * 5/2001 Chuo et al. ..... 349/58
6,231,021 B1 * 5/2001 Hong ..... 248/371
6,354,549 B2 * 3/2002 Sweere et al. ..... 248/292.14
6,505,988 B1 * 1/2003 Oddsen, Jr. ..... 403/110
6,772,983 B1 * 8/2004 Liao et al. ..... 248/291.1
6,905,103 B2 * 6/2005 Kim ..... 248/398
6,986,489 B2 * 1/2006 Oddsen, Jr. ..... 248/289.11
7,048,242 B2 * 5/2006 Oddsen, Jr. ..... 248/280.11
7,096,560 B2 * 8/2006 Oddsen, Jr. ..... 29/525.11
7,226,028 B2 * 6/2007 Lin ..... 248/291.1
7,335,147 B2 * 2/2008 Jones et al. ..... 482/148
2006/0197003 A1 * 9/2006 Oddsen, Jr. ..... 248/279.1
2006/0231713 A1 * 10/2006 Crain et al. ..... 248/309.1
2007/0037667 A1 * 2/2007 Gordon ..... 482/51

* cited by examiner

*Primary Examiner*—Terrell Mckinnon
*Assistant Examiner*—Robert F Long

(57) ABSTRACT

A mechanism mounted on a stationary exercise bicycle including a frame, a rear seat, a front drive mechanism having a pedal at either side, and a numeric display is disclosed. In one embodiment, the mechanism includes a mounting assembly fixedly mounted at one side of the frame and including upper and lower mounting lugs; and an arm including an upper section secured to the display and a lower section having a distal end releasably secured to the upper section and a proximal end pivotably fastened between the mounting lugs. The display is adapted to dispose in a first position in front of the seat, in a second position at one side of the frame or in a position between the first position and the second position by pivoting about the mounting assembly.

7 Claims, 13 Drawing Sheets

PIVOTAL DISPLAY FOR STATIONARY EXERCISE BICYCLE

BACKGROUND OF THE INVENTION

1. Field of Invention

The invention relates to exercise equipment and more particularly to a display pivotably mounted at one side of a stationary exercise bicycle so as to not hinder straddling, leaving, or pedaling the exercise bicycle as well as permit a person to adjust an angle of the display to the seat.

2. Related Art

The fitness craze which has captivated the attention of ever increasing numbers of people throughout the world has spawned many types of exercise equipment. One popular type of indoor exercise devices is the stationary exercise bicycle. This exercise bicycle enables a person to pedal a simulated bicycle as a form of exercise.

A conventional stationary exercise bicycle is shown in FIG. 1 and comprises a rear seat 3, a front drive mechanism 2 having a pedal at either side, and a numeric display 1 extended upright from a top of the drive mechanism 2.

However, the well known stationary exercise bicycle is disadvantageous. In detail, a distance between the seat 3 and the display 1 is relatively long. Thus, a person sitting on the seat 3 may be unable to see clearly what is shown on the display 1. A proposal of incorporating a horizontal adjustment mechanism in the display 1 can solve the problem. However, it can cause a further problem of hindering pedaling, straddling, or leaving the exercise bicycle if the distance between the seat 3 and the display 1 is relatively short. Thus, the need for improvement still exists.

SUMMARY OF THE INVENTION

It is therefore an object of the present invention to provide a mechanism mountable on a stationary exercise bicycle including a frame, a rear seat, a front drive mechanism having a pedal at either side, and a numeric display, comprising a mounting assembly fixedly mounted at one side of the frame and including upper and lower mounting lugs; and an arm including an upper section secured to the display and a lower section having a distal end releasably secured to the upper section and a proximal end pivotably fastened between the mounting lugs, wherein the display is adapted to dispose in a first position in front of the seat, in a second position at one side of the frame or in a position between the first position and the second position by pivoting on a vertical axis about the mounting assembly.

In another aspect of the present invention the sliding mounting assembly further comprises a plate fixedly secured to the frame, the plate including horizontal upper and lower longitudinal rails, and a sliding member fixedly secured to the mounting lugs, the sliding member including one or more rollers and two side flanges slidably secured to the plate.

It is another object of the present invention to provide a mechanism mountable on a stationary exercise bicycle including a frame, a rear seat, a front drive mechanism having a pedal at either side, and a numeric display, comprising a mounting assembly pivotably mounted at one side of the frame and including upper and lower mounting lugs; and an arm including an upper section secured to the display and a lower section having a distal end releasably secured to the upper section and a proximal end pivotably fastened between the mounting lugs, wherein the display is adapted to dispose in a first position in front of the seat, in a second position at one side of the frame or in a position between the first position and the second position by pivoting about the mounting lugs, by pivoting the mounting lugs about the frame, or by pivoting about the mounting lugs and by pivoting the mounting lugs about the frame.

It is a further object of the present invention to provide a mechanism mountable on a stationary exercise bicycle including a frame, a rear seat, a front drive mechanism having a pedal at either side, and a numeric display, comprising a mounting assembly slidably mounted at one side of the frame and including upper and lower mounting lugs; and an arm including an upper section secured to the display and a lower section having a distal end releasably secured to the upper section and a proximal end pivotably fastened between the mounting lugs, wherein the display is adapted to dispose in a first position in front of the seat, in a second position at one side of the seat, or in a position between the first position and the second position by pivoting about the mounting assembly, by sliding the mounting assembly relative to the frame, or by pivoting about the mounting assembly and by sliding the mounting assembly relative to the frame.

In one aspect of the present invention the arm further comprises an L-shaped handle bar joined to the upper section and extended rearward.

In another aspect of the present invention the sliding mounting assembly further comprises a plate fixedly secured to the frame, the plate including upper and lower longitudinal rails, and a sliding member fixedly secured to the mounting lugs, the sliding member including one or more rollers and two side flanges slidably secured to the plate.

The above and other objects, features and advantages of the present invention will become apparent from the following detailed description taken with the accompanying drawings.

DETAILED DESCRIPTION OF THE INVENTION

Figure 1:
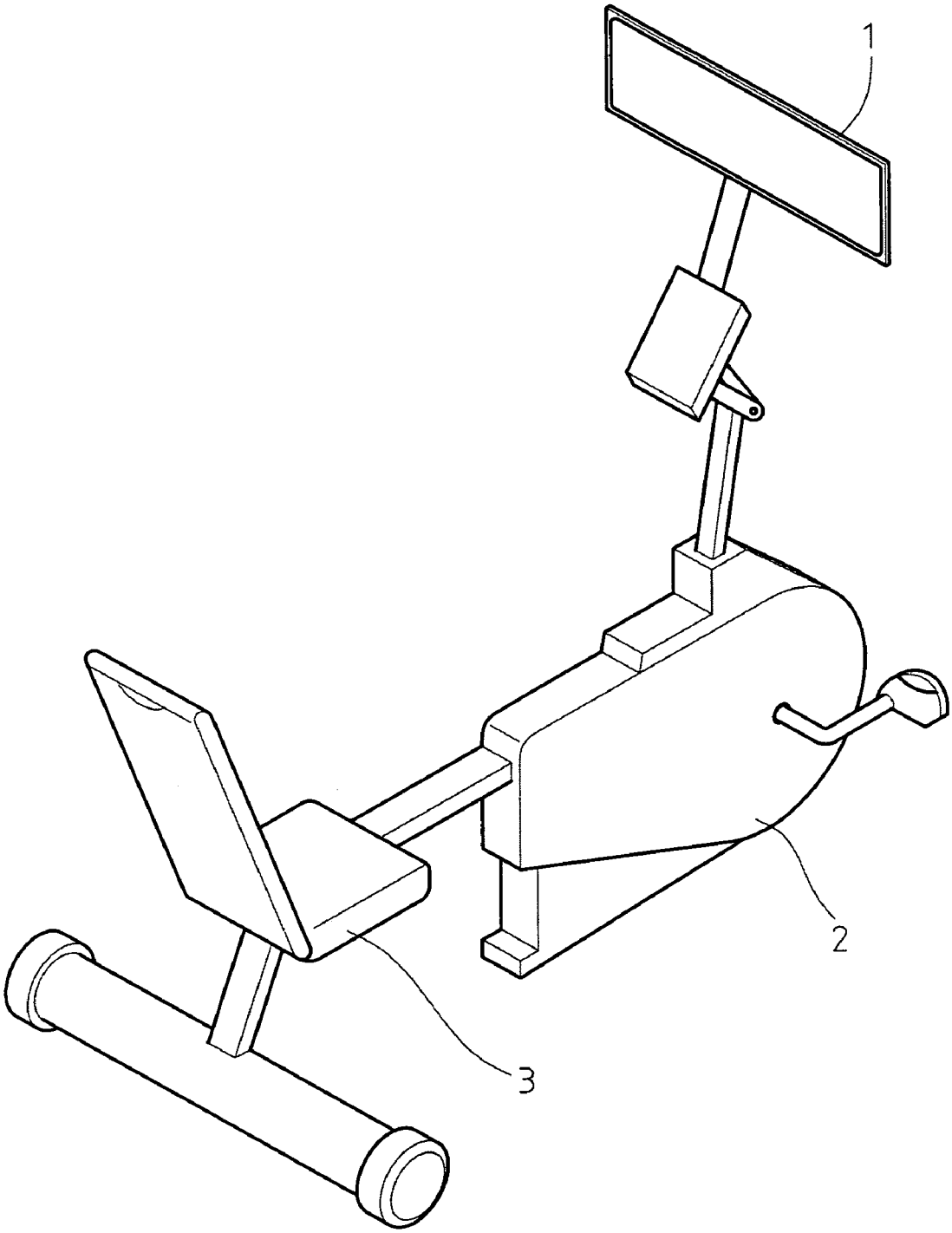
PRIOR ART FIG. 1
FIG. 1 is a perspective view of a conventional stationary exercise bicycle.
Figure 2:
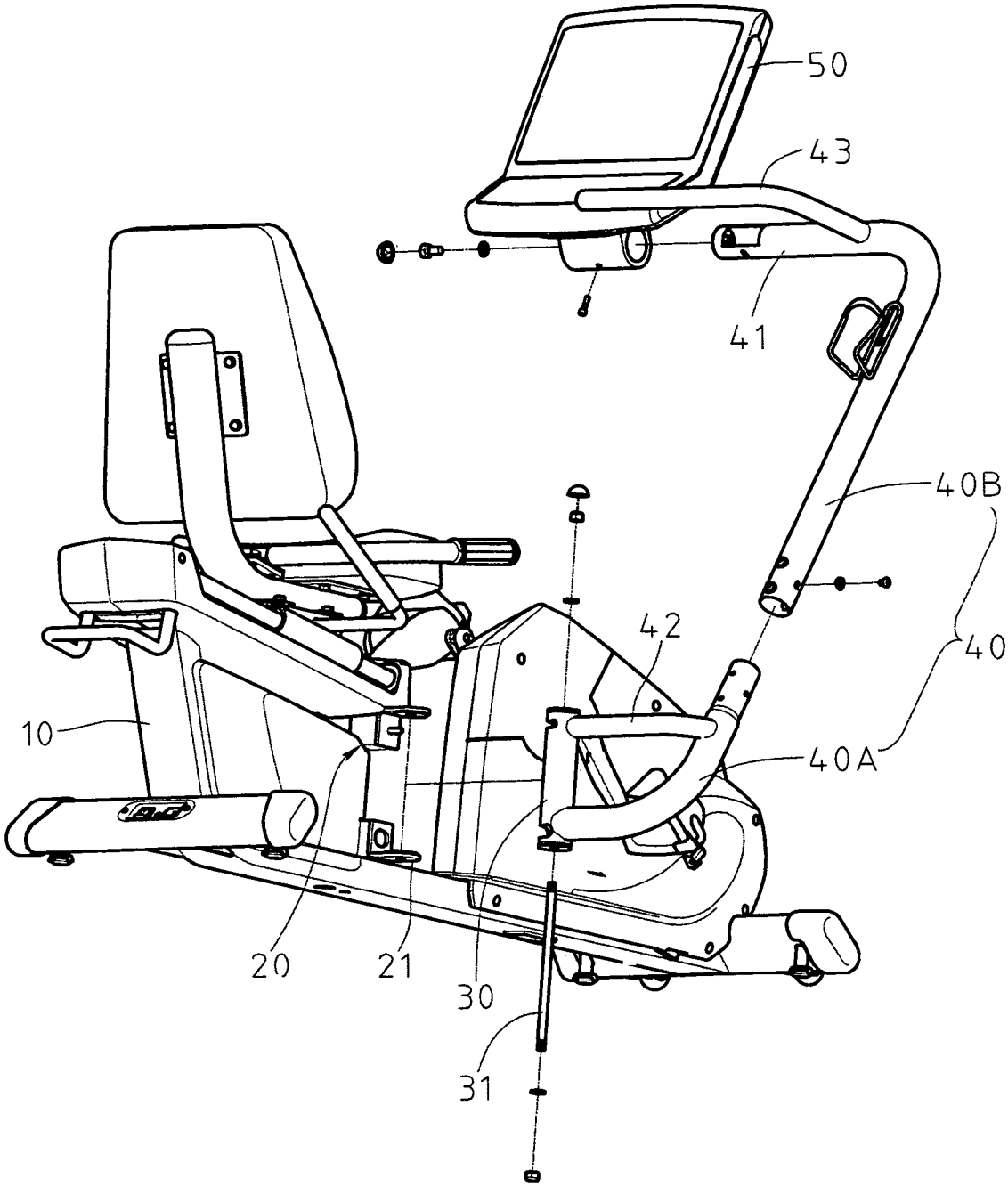
FIG. 2 is an exploded perspective view of a stationary exercise bicycle according to the present invention.

Referring to FIGS. 2 to 8, a stationary exercise bicycle in accordance with the present invention has a frame including a base 10 having a rear seat, a front drive mechanism having a pedal at either side, and a numeric display 50 disposed above the drive mechanism. The subject of the present invention is a mechanism pivotably connecting the display 50 to one side of the base 10 as detailed below.

The pivot mechanism comprises a mounting assembly 20 fixedly mounted at one side of the base 10 and including upper and lower mounting lugs 21.

The pivot mechanism further comprises an arm 40 including a bent lower section 40A having a proximal end fixedly secured to a lower end of a tube 30, the lower section 40A including an auxiliary tube 42 fixedly interconnected the lower section 40A and an upper end of the tube 30 for increasing the structural strength of the arm 40, the tube 30 being pivotably fastened on a vertical axis between the mounting lugs 21 by using a pivot pin 31 and other associated fasteners known in the art.

The arm 40 further comprises a bent upper section 40B having a proximal end releasably secured to a distal end of the lower section 40A, the upper section 40B having a distal end 41 threadedly secured to a bottom sleeve of the display 50 and including an L-shaped handle bar 43 joined to the distal end 41 and extended rearward.

Figure 3:
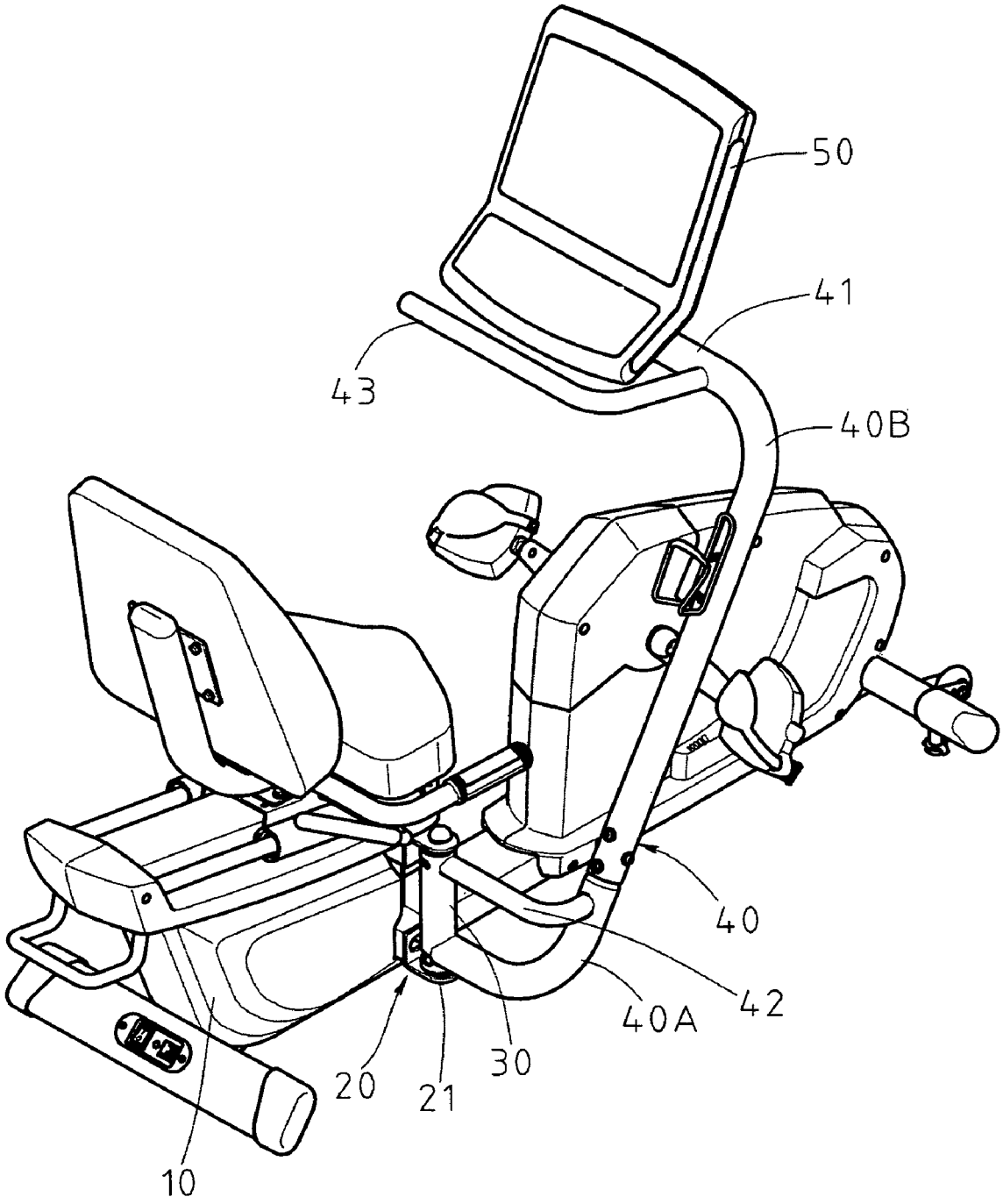
FIG. 3 is a perspective view of the assembled exercise bicycle in FIG. 2.
Figure 4:
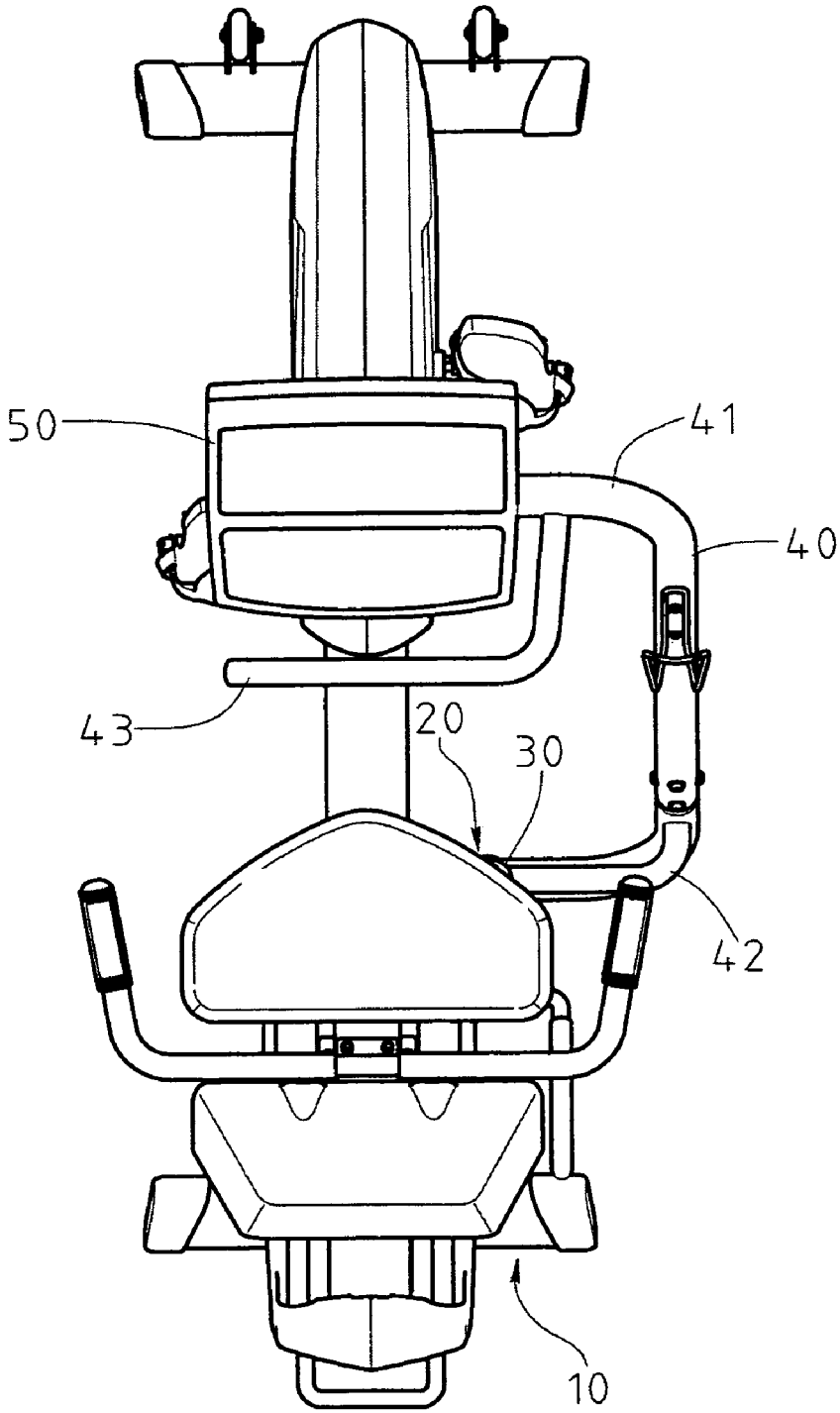
FIG. 4 is a top plan view of FIG. 3.

An inoperative position of the exercise bicycle is shown in FIGS. 3 and 4 in which the display 50 is disposed in front of the seat. For straddling the seat, a person may hold the handle bar 43 and pivot the arm 40 rightward about 90 degree relative to the mounting assembly 20 until the display 50 is disposed at one side of the exercise bicycle (see FIGS. 5 and 6). To the contrary, after use the person may perform the above operation in the opposite direction in order to return the exercise bicycle to its inoperative position. In such a manner, either straddling or leaving the exercise bicycle is not hindered.

Figure 5:
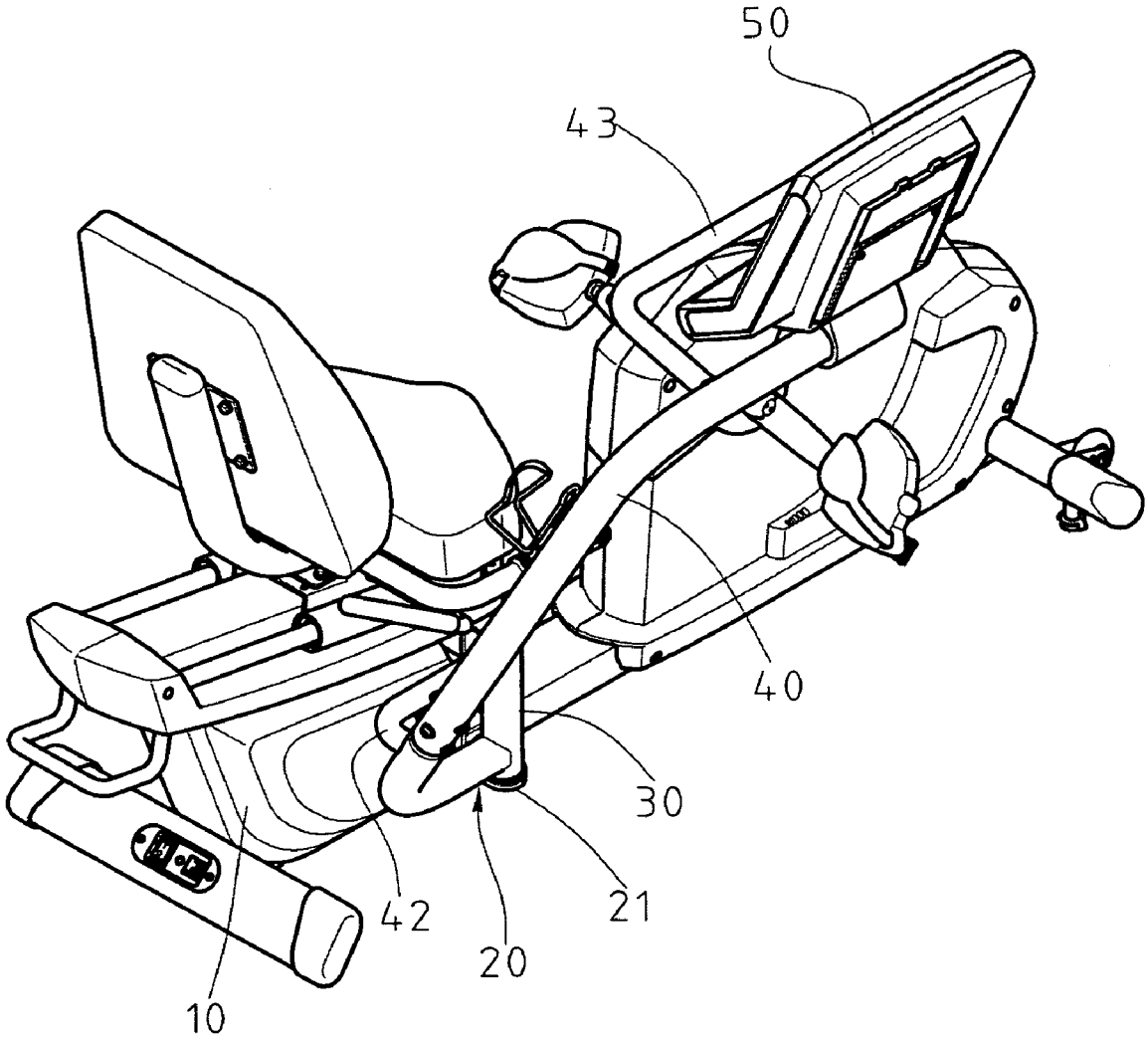
FIG. 5 is another perspective view of FIG. 3 where the display is pivoted about 90 degree from the position of FIG. 3 to one side of the exercise bicycle.
Figure 6:
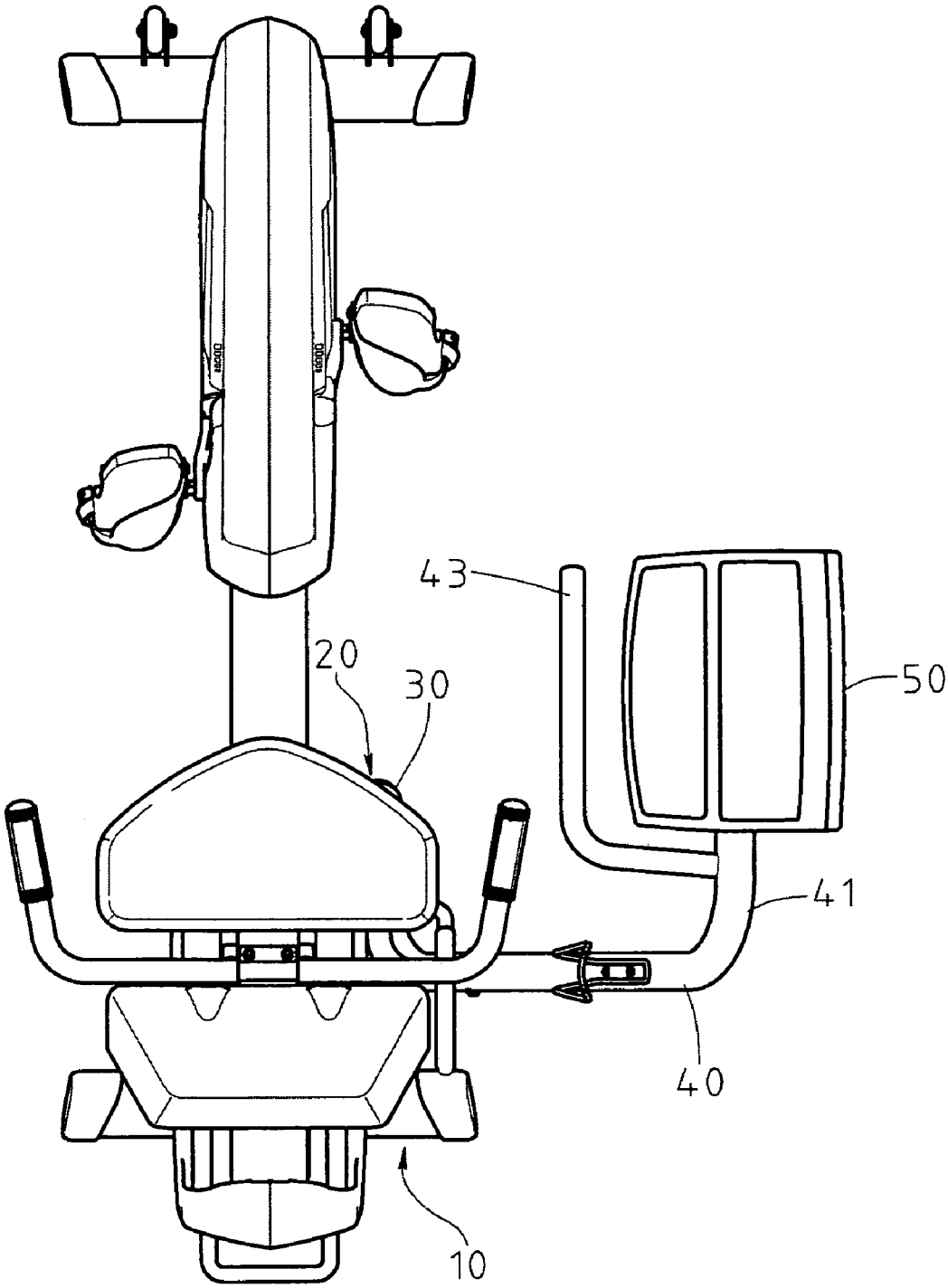
FIG. 6 is a top plan view of FIG. 5.
Figure 7:
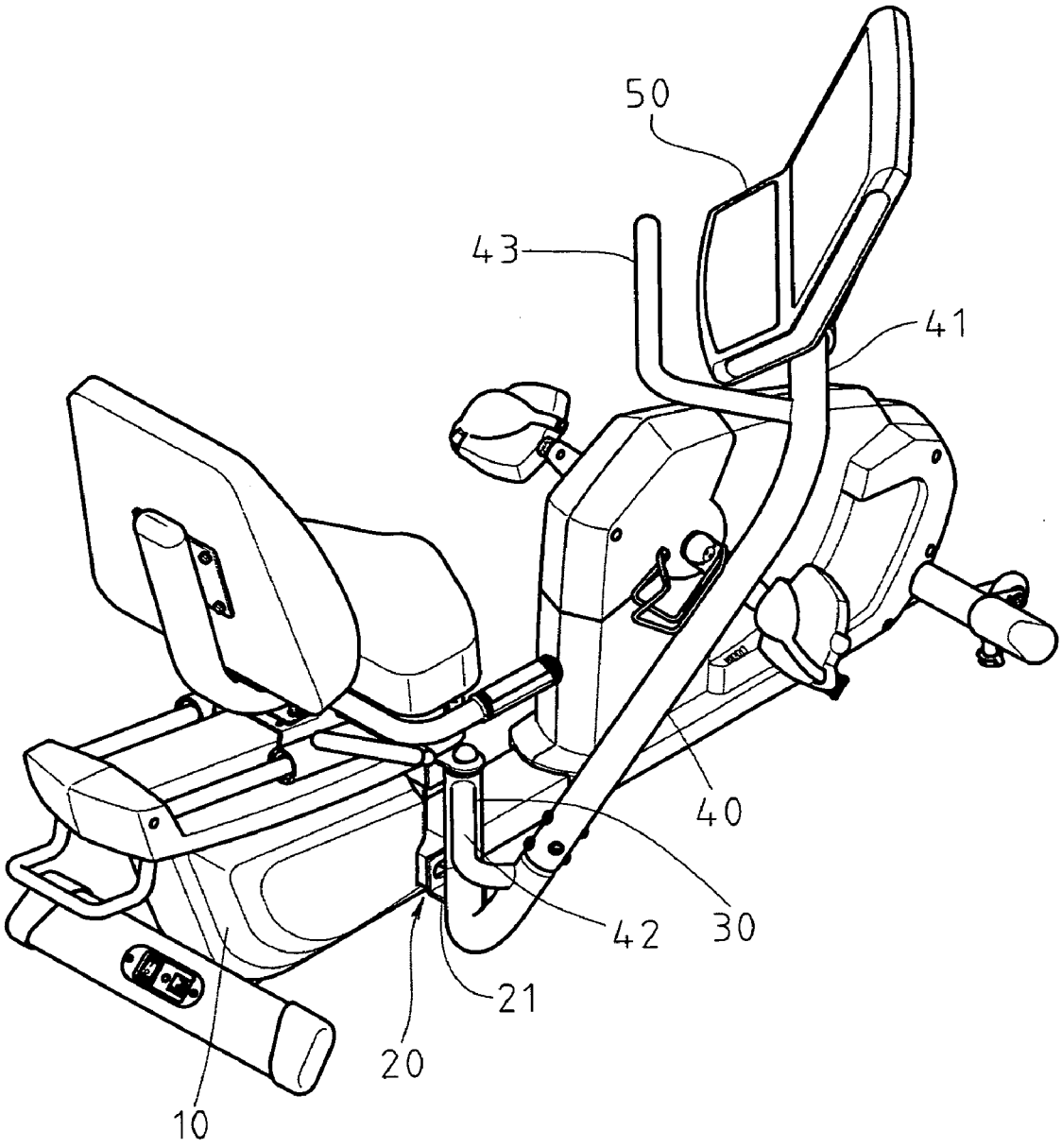
FIG. 7 is still another perspective view of FIG. 3 where the display is disposed at a position about midway between the position of FIG. 3 and the position of FIG. 5.
Figure 8:
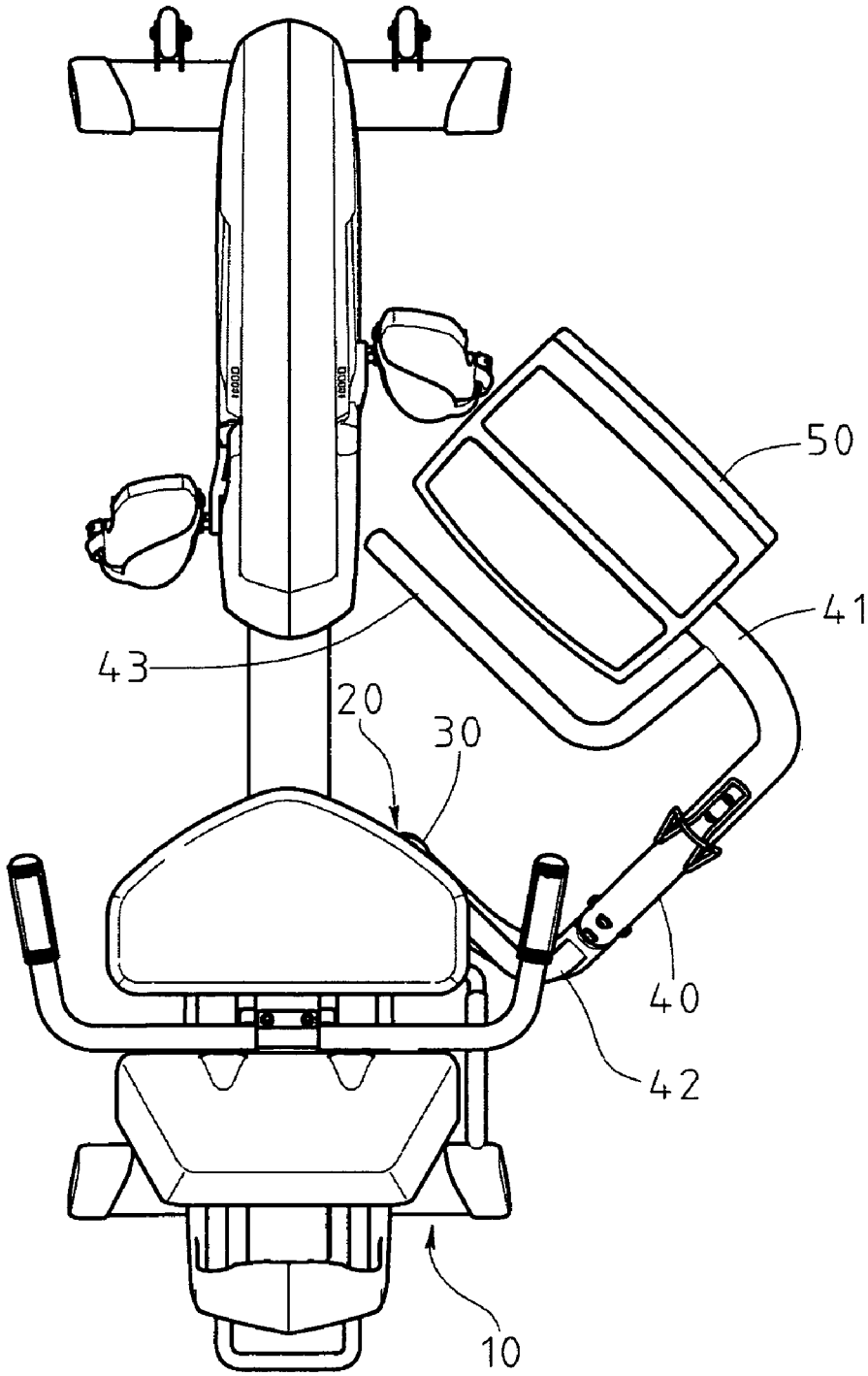
FIG. 8 is a top plan view of FIG. 7.

As shown in FIGS. 7 and 8, the display 50 is disposed at a position about midway between the position of FIG. 3 and the position of FIG. 5 by pivoting. In this position, a person sitting on the seat may pedal while watching value (e.g., speed) shown on the display 50. Accordingly, the person may adjust the exercise if such need arises.

Figure 9:
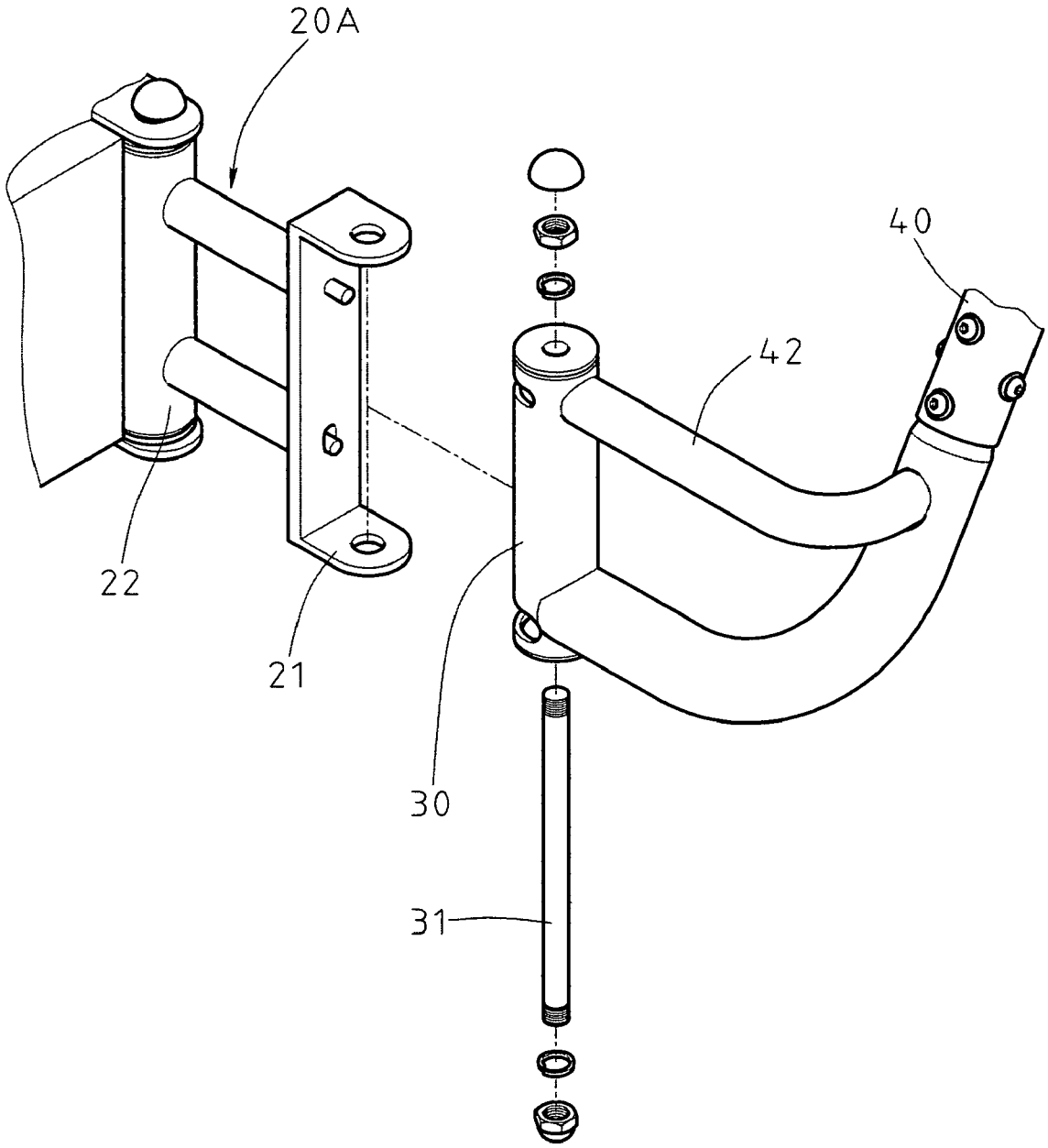
FIG. 9 is an exploded view of the components of a lower portion of the arm to be assembled with a mounting assembly according to a second preferred embodiment of the present invention.
Figure 10:
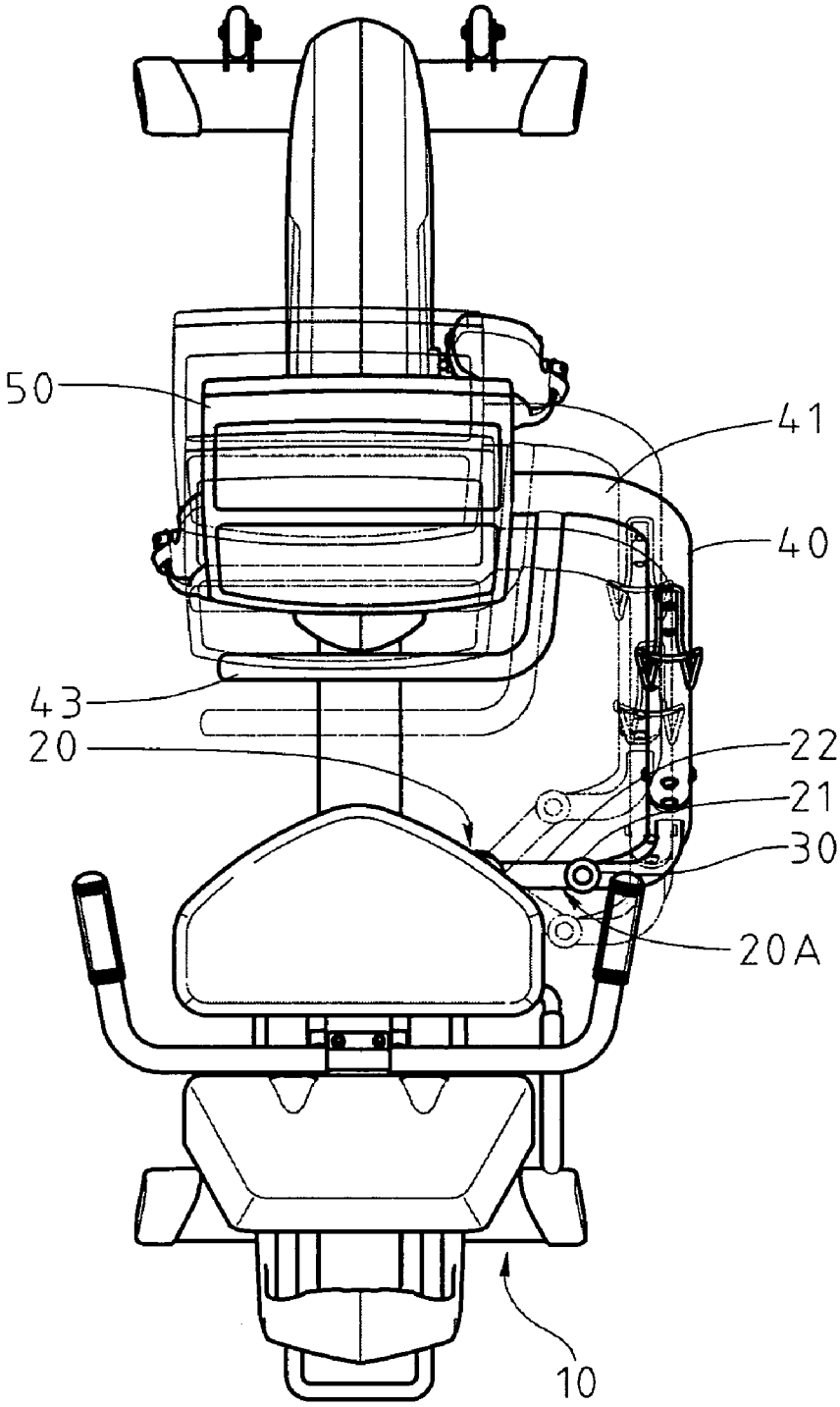
FIG. 10 is a top plan view of the exercise bicycle incorporating the mounting assembly of the second preferred embodiment for showing its operation.

Referring to FIGS. 9 and 10, a mounting assembly 20A according to a second preferred embodiment of the present invention is shown. The mounting assembly 20A comprises a U-shaped outer member 21 having upper and lower mounting lugs for pivotably fastening the tube 30 therebetween, and a bar-like inner member 22 pivotably secured to the base 10 and fixedly secured to the outer member 21 respectively. Hence, the arm 40 is adapted to pivot about the mounting assembly 20A and the mounting assembly 20A is adapted to pivot about the base 10 respectively during an angle adjustment of the display 50 relative to the person sitting on the seat. The second preferred embodiment has the advantages of fine angle and position adjustments of the display 50.

Figure 11:
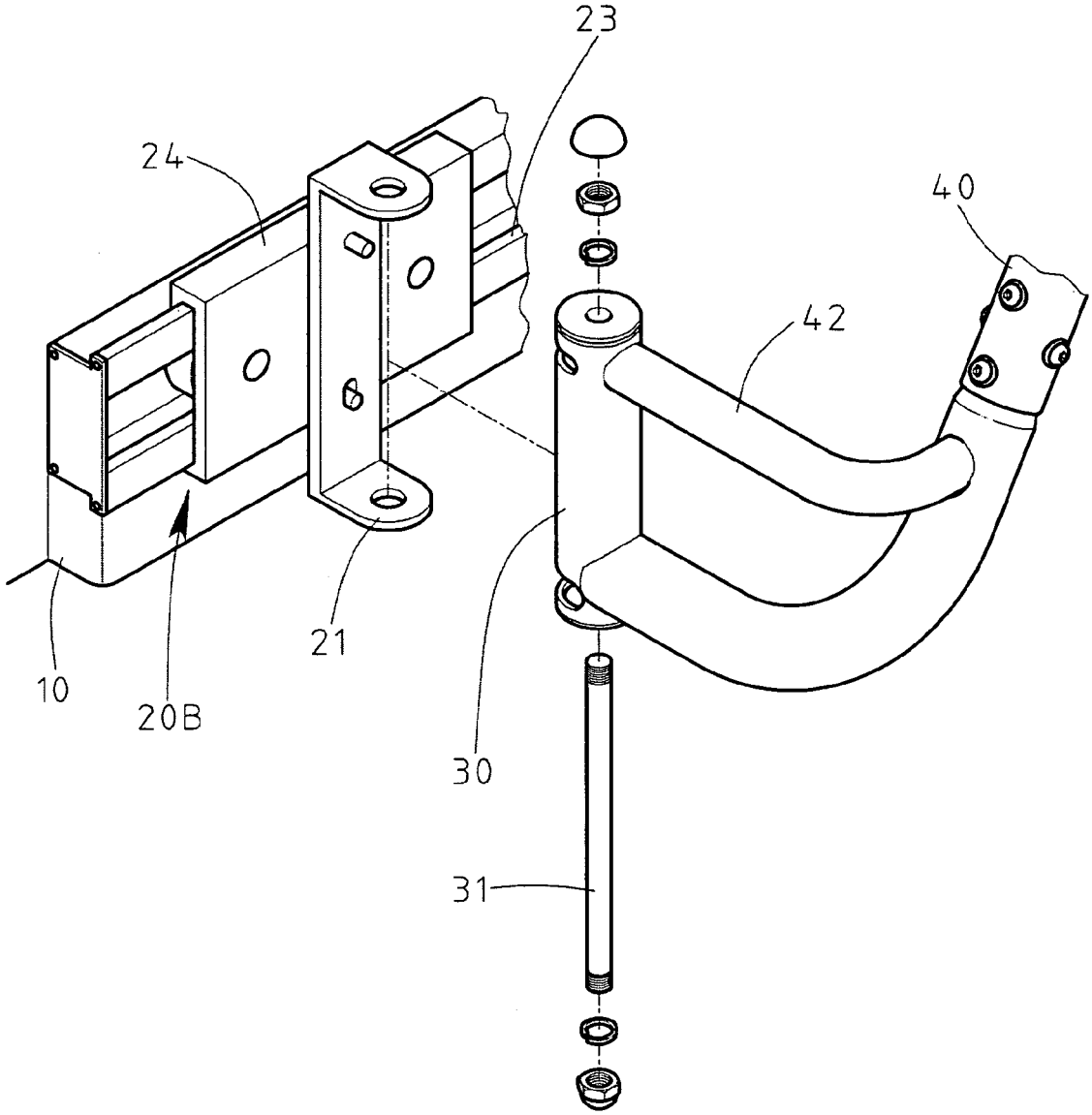
FIG. 11 is an exploded view of the components of a lower portion of the arm to be assembled with a mounting assembly according to a third preferred embodiment of the present invention.
Figure 12:
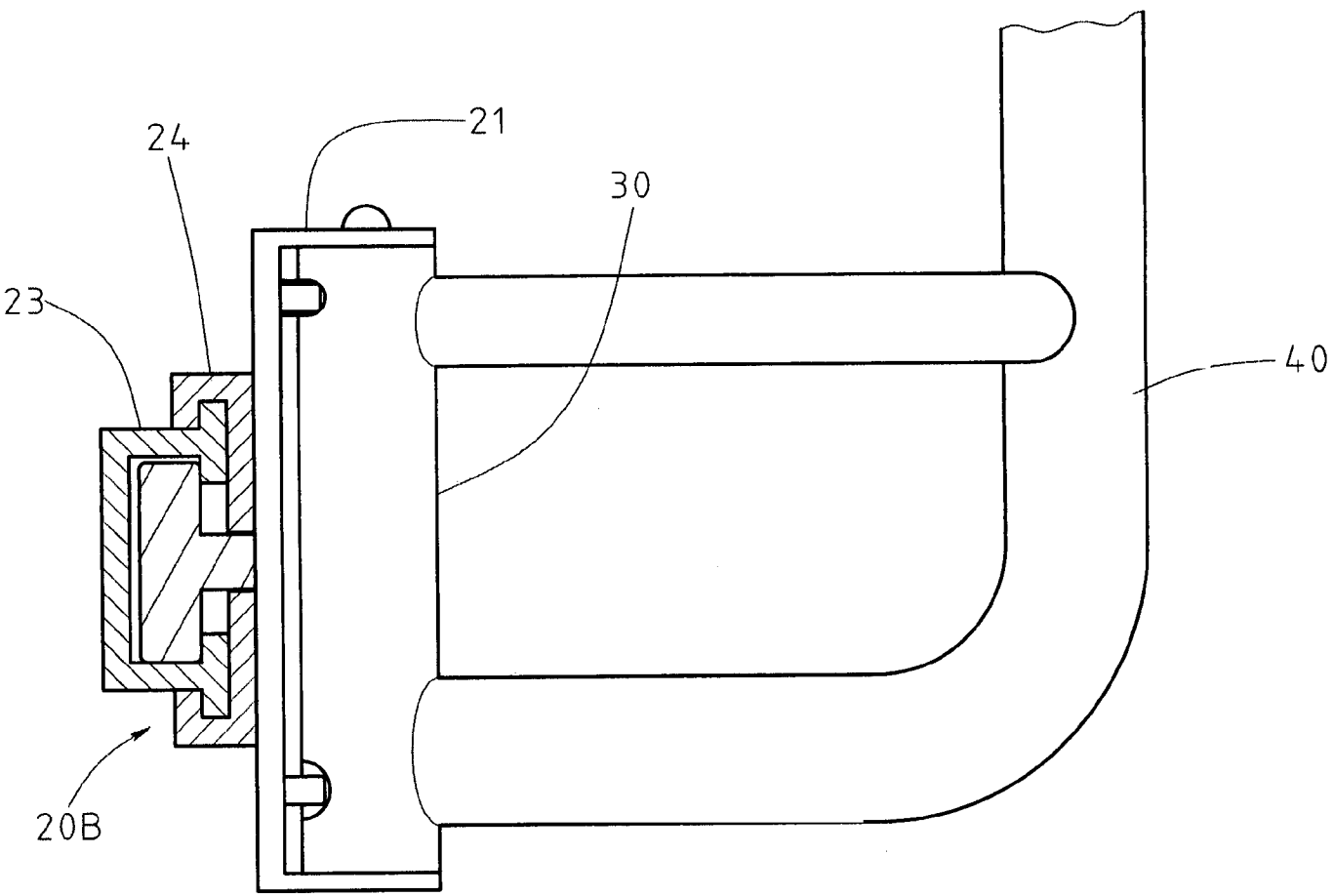
FIG. 12 is a rear view in part section of the assembled mounting assembly of FIG. 11.
Figure 13:
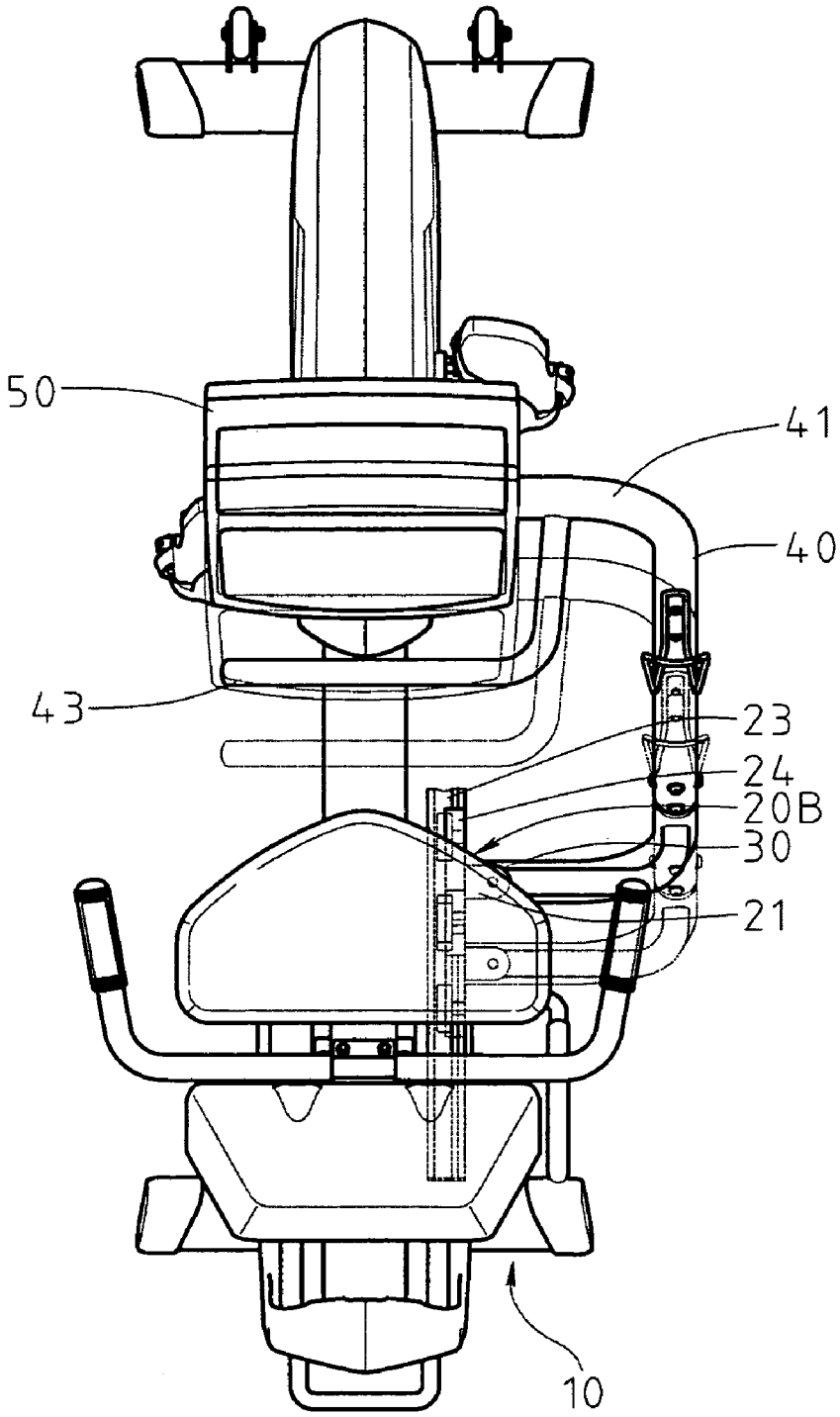
FIG. 13 is a top plan view of the exercise bicycle incorporating the mounting assembly of the third preferred embodiment for showing its operation.

Referring to FIGS. 11, 12, and 13, a mounting assembly 20B according to a third preferred embodiment of the present invention is shown. The mounting assembly 20B comprises a U-shaped outer member 21 having upper and lower mounting lugs for pivotably fastening the tube 30 therebetween, a plate 23 fixedly secured to the base 10 and including upper and lower longitudinal rails, and a sliding member 24 fixedly secured to the outer member 21 and slidably secured to the plate 23 by a roller respectively. Hence, the arm 40 is adapted to pivot about the mounting assembly 20B (i.e., the outer member 21) and the mounting assembly 20B (i.e., the sliding member 24) is adapted to slide about the base 10 respectively during an angle adjustment of the display 50 relative to the person sitting on the seat. The third preferred embodiment also has the advantages of fine angle and position adjustments of the display 50.

It is to be understood that the present invention is by no means limited only to the particular constructions herein disclosed and shown in the drawings, but also comprises any modifications or equivalents within the scope of the claims.

What is claimed is:

1. A mechanism mountable on a stationary exercise bicycle that has a frame, a rear seat, a front drive mechanism having a pedal at either side, and a numeric display, said mechanism comprising:

a mounting bracket fixedly mounted at one side of the frame and including upper and lower mounting lugs;

a pivot mounted to said mounting lugs and having a vertically oriented axis;

a lower arm section having a proximal end connected to said pivot, and a distal end upwardly inclined in a forward direction; and an upper arm section including an upper end portion secured to the display and a lower end portion adapted to be releasably secured to the lower arm section;

wherein the display is adapted to dispose in a first position in front of the seat, in a second position at one side of the frame or in a position between the first position and the second position by pivoting about the mounting assembly.

2. The mechanism of claim 1, wherein the upper arm section further comprises an L-shaped handle bar joined to the upper arm section and extended rearward.

3. A mechanism mountable on a stationary exercise bicycle that has a frame, a rear seat, a front drive mechanism having a pedal at either side, and a numeric display, said mechanism comprising:

a mounting bracket fixedly mounted at one side of the frame and including upper and lower mounting lugs;

a pivot mounted to said mounting lugs and having a vertically oriented axis;

a lower arm section having a proximal end connected to said pivot, and a distal end upwardly inclined in a forward direction; and an upper arm section including an upper end portion secured to the display and a lower end portion adapted to be releasably secured to the lower arm section ;

wherein the display is adapted to dispose in a first position in front of the seat, in a second position at one side of the frame or in a position between the first position and the second position by pivoting about the mounting lugs, by pivoting the mounting lugs about the frame, or by pivoting about the mounting lugs and by pivoting the mounting lugs about the frame.

4. The mechanism of claim 3, wherein the upper arm section further comprises an L-shaped handle bar joined to the upper arm section and extended rearward.

5. A mechanism mountable on a stationary exercise bicycle that has a frame, a rear seat, a front drive mechanism having a pedal at either side, and a numeric display, said mechanism comprising: a mounting bracket fixedly mounted at one side of the frame and including upper and lower mounting lugs;

a pivot mounted to said mounting lugs and having a vertically oriented axis;

a lower arm section having a proximal end connected to said pivot, and a distal end upwardly inclined in a forward direction; and an upper arm section including an upper end portion secured to the display and a lower end portion having adapted to be releasably secured to the lower arm section;

wherein the display is adapted to dispose in a first position in front of the seat, in a second position at one side of the seat, or in a position between the first position and the second position by pivoting about the mounting assembly, by sliding the mounting assembly relative to the frame, or by pivoting about the mounting assembly and by sliding the mounting assembly relative to the frame.

6. The mechanism of claim 5, wherein the upper arm section further comprises an L-shaped handle bar joined to the upper arm section and extended rearward.

7. The mechanism of claim 5, wherein the mounting assembly further comprises a plate fixedly secured to the frame, the plate including substantially horizontal upper and lower longitudinal rails, and a sliding member fixedly secured to the mounting lugs, the sliding member including one or more rollers and two side flanges slidably secured to the plate.

* * * * *